US006239361B1

(12) United States Patent
Snaper

(10) Patent No.: US 6,239,361 B1
(45) Date of Patent: May 29, 2001

(54) REMOTE REPLICATION AND TRANSLATION OF A MAGNETIC FIELD

(76) Inventor: Alvin A. Snaper, 2800 Cameo Cir., Las Vegas, NV (US) 89107

( * ) Notice: Subject to any disclaimer, the term of this patent is extended or adjusted under 35 U.S.C. 154(b) by 0 days.

(21) Appl. No.: 09/368,319

(22) Filed: Aug. 3, 1999

(51) Int. Cl.[7] ..... H01B 11/12
(52) U.S. Cl. ..... 174/36; 174/113 R; 174/128.1
(58) Field of Search ..... 174/126.1, 126.2, 174/128.1, 36, 113 R; 29/609, 607, 598

(56) References Cited

U.S. PATENT DOCUMENTS 3,443,914 * 5/1969 Hayashi ..... 174/126.1 X
4,704,789 * 11/1987 Ito et al. ..... 29/609
4,785,244 * 11/1988 Jin et al. ..... 324/260
5,170,015 * 12/1992 Kudo et al. ..... 174/128.1

* cited by examiner

*Primary Examiner*—Dean A. Reichard
*Assistant Examiner*—Chau N. Nguyen
(74) *Attorney, Agent, or Firm*—Donald D. Mon

(57) ABSTRACT

A cable to translate a magnetic field from one end to the other end of the cable. The cable includes a plurality of axially-extending strands of magnetic core, individually surrounded by non-magnetic claddings, the strands being parallel and coherently arranged. The cable can usefully be placed in a passage through a barrier in structural and fluid sealing relationships with its wall to translate the image of a magnetic field from one side of the wall to the other.

8 Claims, 2 Drawing Sheets

REMOTE REPLICATION AND TRANSLATION OF A MAGNETIC FIELD

FIELD OF THE INVENTION

Remote replication and translation of a magnetic field for such purposes as imaging the field, and/or for translating its energy for utilization elsewhere.

BACKGROUND OF THE INVENTION

A magnetic field's local properties are often a matter of interest and are subjected to measurement and observation by devices that are exposed to the field and act as sensors to produce a signal respective to a measured property of the field. Sensors for this purpose are well-known, and operate as magneto-inductive, magneto-resistive, bias magnetic field, and Hall effect devices, for example. Such sensors to detect, measure and analyze magnetic fields, and provide readout means for measurement purposes are well-known and are being continuously improved.

Such known devices function well for their intended purposes of detection and measurement. It is known for them to be used as trigger means to respond to abrupt changes in a magnetic field, for example. Their objective is to respond to a circumstance that is respective to a desired or objectionable situation. This invention is not directed toward the sensing or measurement of a magnetic field, nor to devices responsive to the strength of the field nor to a change in the properties of the field.

Instead, this invention is directed to the translation and replication of the magnetic field itself (or of a part thereof), which can be utilized remotely at a removed site for observation of its characteristics, and even for the electromechanical properties of magnetic flux drive as though the using device were located in the place where the magnetic field is initially generated.

For example, with this invention an image of the field itself can be remotely obtained, as can a wide-area flux field. The flux field is functionally identical to its "parent" but is intended for use in a remote region. Transfer of magnetic flux through a physical barrier and its ultimate utilization beyond the barrier is now attainable.

Rather than transmitting mechanical energy by a rotary shaft through a barrier such as a hull to a user device such as a propeller, a magnetic field now can instead be translated through a rigid immobile barrier. It can then be utilized on the outside by an exterior rotary device that could be coupled to a user device such as a propeller that is journaled outside of the hull, or to a rotatable device which can be used to generate electricity. With such an arrangement it is not necessary to provide a rotary seal around a drive shaft that is sealed and journaled in a barrier such as a hull. Instead, this device utilizes a rigid and stationary translation technique that itself seals the passage in which it is fitted, and which resists push-out forces that might dislodge it. With this device, it is only the translated field that rotates.

In addition to providing a rotating field for remote use, this invention can also provide for translation of stationary fields for measurement and observation.

BRIEF DESCRIPTION OF THE INVENTION

This invention includes a cable having a dimension of length, a cross-section, and a first and a second end. The cable comprises an axially extending matrix of a plurality of parallel strands of magnetizable material. These strands are magnetically insulated from one another by non-magnetizable material.

The strands have cross-section areas smaller than the total cross-section area of the cable, and are preferably present in a substantial number. The strand arrangement is coherent in the sense that the position of each strand in the cross-section relative to every other strand is consistent from end to end of the cable. Thus, an image captured at the first end of the cable is precisely the same as the image replicated at the second end. This is a common concept in fiber optic cables, and it is used herein in the same sense in the translation of a magnetic image by this cable, rather than an optical image.

Thus, the magnetic field presented to the first end of the cable is replicated at the second end, and can be observed and utilized at the second end precisely as it could have been at the first end. The term "translation" is used herein in the sense of displacement as an entirety from one location to another.

According to this invention the cable includes a number of strands sufficient to provide such resolution of the field as is required for the intended usage.

According to a preferred but optional feature of the invention, the strands comprise a magnetizable metal core and a cladding of non-magnetic metal.

According to yet another optional feature of the invention, the magnetic core of each strand can be surrounded by an optically-transmissive cladding simultaneously to convey a coherent visual image.

The above and other features of this invention will be fully understood from the following detailed description and the accompanying drawings, in which:

DETAILED DESCRIPTION OF THE INVENTION

A cable 10 according to this invention is shown fixed in a passage 11 through a barrier wall 12. The barrier wall may be part of a vessel enclosing dangerous materials or conditions, or a structurally integral part of the hull of a surface ship or a submarine. In either situation it will pass through the barrier wall from one side to the other. The objective is to translate a magnetic field from one side of the barrier wall to the other so it can be observed or utilized. The cable in the barrier wall is sufficiently strong to resist forces that may tend to press it out, and also is impermeable to water.

Figure 1:
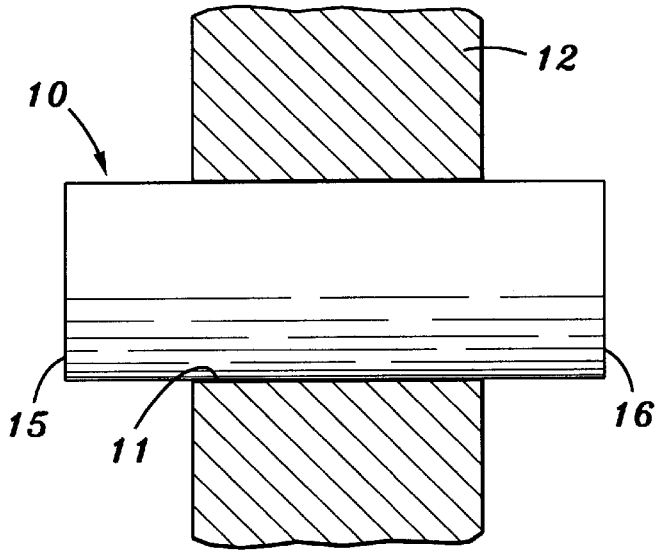
FIG. 1 is a side view, partly in cutaway cross-section showing a cable passing through a barrier.
Figure 2:
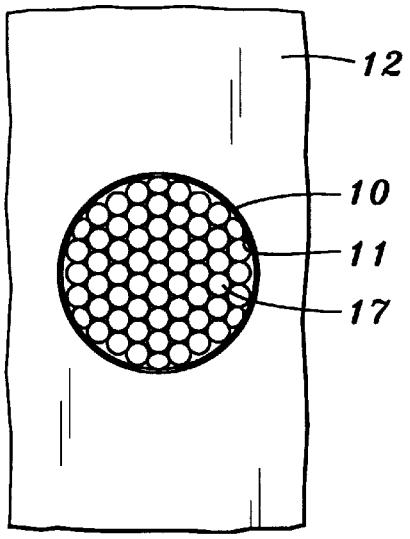
FIG. 2 is a right hand view of FIG. 1.

As best shown in FIGS. 1 and 2, the cable has a first end 15 and a second end 16. Between these ends there extends a plurality of strands 17.

The strands are parallel and coherent. By coherent is meant that each strand occupies the same relative position in the cross-section of the cable at both ends. Thus the magnetic image at both ends is the same. The ends of the cable are preferably but not necessarily smoothly finished, planar, and normal to the cable axis.

A magnetic field captured by the cable at the first end will exit the carrier at the second end as a precise replica.

Respective portions of the image will be transmitted by the individual strands. The image will, of course, be grainy, just as with optical fibers. Reduction of strand diameter and increase in the number of strands per unit area will increase the resolution of the image. However, any plural number of stands will create at least some image, so the invention is not limited to any particular size or number of strands per unit of cross-section area.

While strands with a circular cross-section will ordinarily be preferred for convenience in manufacture and availability, other cross-sections are equally useful, and sometimes preferable. For example, rectangular cross-sections will enable a larger packing ratio, i.e., the ratio of the cross-section of the magnetizable material to the total area of the cable. The difference will be in the total cross-section of the cladding non-magnetizable material. Also different cross-sections may be utilized in different areas of larger total cross-sections.

Sizes so small as to pack 1,000 clad strands in a one square inch section may be used, especially when the precise nature of the field is of interest. A lesser resolution, i.e. in a cable of perhaps 24 inches diameter may provide a suitable resolution for a large field with strands whose diameter is on the order of ⅛ to 3⁄16 inches diameter.

The cladding will be kept as thin as possible. It will be provided in a thickness only sufficient to prevent magnetic "leakage" between strands. Such leakage would compromise the resolution of the image. It should be kept in mind that the objective of this invention is not to magnetize a cable, but rather to convey through the strands of the cable magnetic lines of flux relating to specific locations on a cross-section, thereby to produce a shaped magnetic field useful for all purposes that were attainable by the original field.

Figure 3:
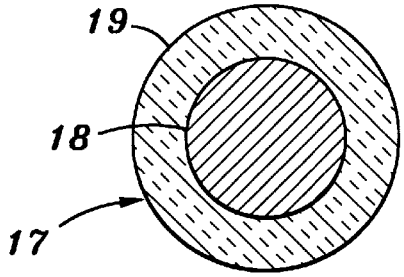
FIG. 3 is a cross-section of a first embodiment of the invention.

The presently-preferred embodiment of a strand 17 is shown in FIG. 3. It has a cylindrical core 18 with a dimension of length and a circular cross-section with a diameter. A cladding 19 (sometimes called a "shield") surrounds it. The core is made of a magnetizable material, preferably ferritic, such as mu metal. This metal does not retain magnetism unless subjected to a field with greater than saturation strength. Care will be taken not to saturate this material. The cladding is a non-magnetizable metal such as copper, brass, aluminum, or silver for example.

Figure 4:
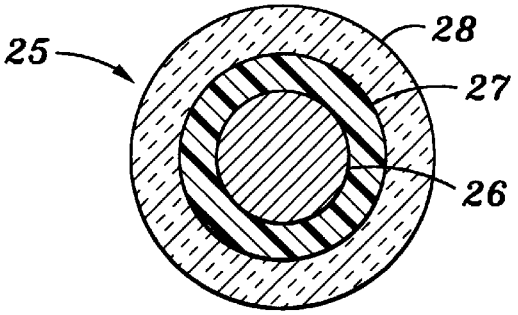
FIG. 4 is a cross-section of a second embodiment of this invention.

An optional type of strand 25 is shown in FIG. 4. It includes a magnetizable core 26, a non-conductive shield 27 and a non-magnetizable cladding 28. Core 26 and cladding 28 are of the same materials as in FIG. 3. Shield 27 provides a non-conductive barrier between the core and cladding for applications in which such shielding would be desirable. Suitable materials as organic plastics (especially polyvinylchloride and polyethylene), ceramics, and paper are examples.

Figure 5:
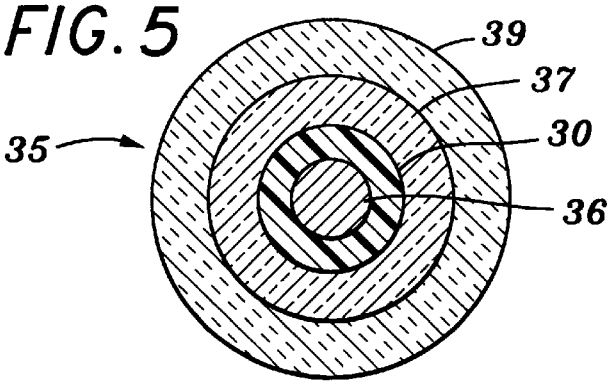
FIG. 5 is a cross-section of a third embodiment of the invention.

Strand 35, shown in FIG. 5 provides for image or light transmission along with magnetic field translation should optical transmission be desired. This can be for illumination or for an image, as desired. A magnetizable core 36, an optional non-conductive shield 37, a tubular fiber optic 38, and a non-magnetizable cladding 39 are concentric and in contiguous contact. Core 36, shield 37 and cladding 39 are of the same materials shown in FIGS. 3 and 4. The material of fiber optic 38 is transparent, and can utilize the same materials as are used in fiber optic devices generally. It may also be used in place of the cladding, because it is not electrically conductive, and can still perform its light transmissive function. Glass will usually not be used, but any of the clear plastics generally used in endoscopes and borescopes will be suitable. When an image is to be transmitted, optic 38 will be a coherent bundle of fibers when the cores are coherently organized.

FIG. 1 illustrates the basic utility of the invention. The cable sealingly passes through the wall, exposed to a magnetic field at its first end, and available for observation and use at its second end. It is structurally sufficiently strong to resist external forces that would press it out of the opening.

Figure 6:
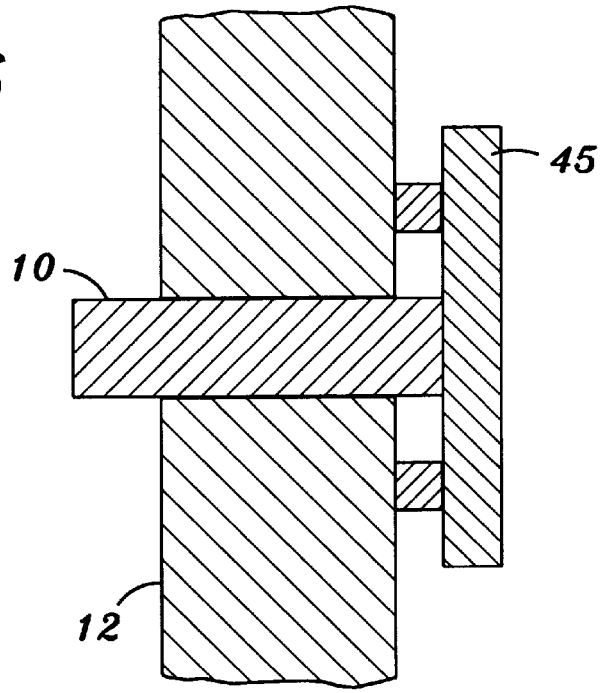
FIG. 6 is an axial cross-section of a user device.

FIG. 6 shows a stationary plate 45 which is transmissive of the magnetic material to which iron filings or the like may be applied to observe the shape of the field. This is, of course, a simplistic application. Much more sophisticated means can be used to learn the specifics of the field at the exposed end.

Figure 7:
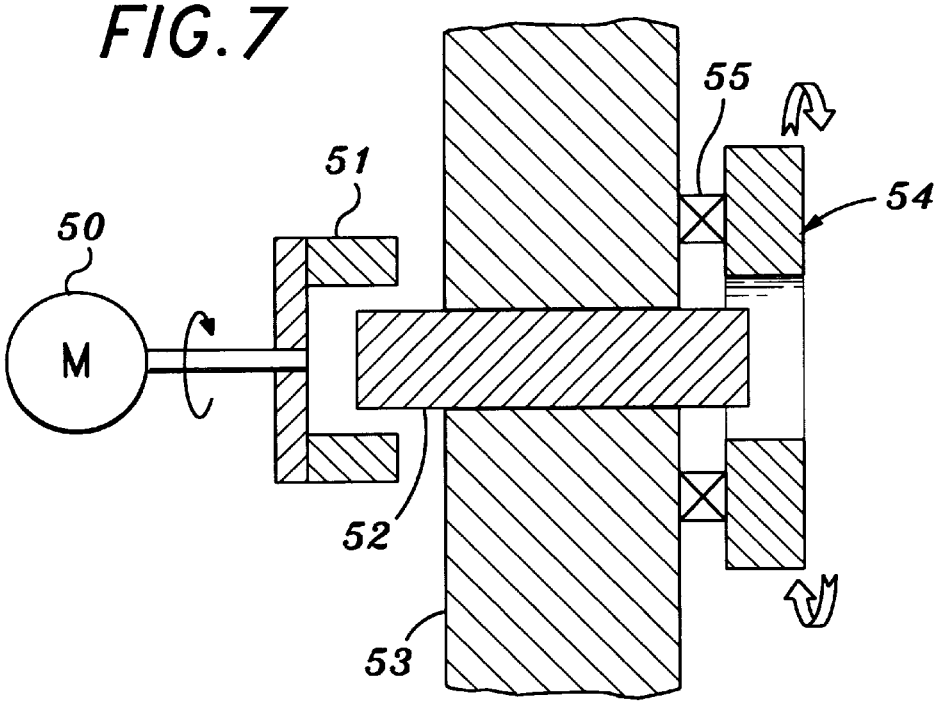
FIG. 7 is an axial cross-section of yet another user device.

FIG. 7 shows a practical application, where a motor 50 or other motive means drives a generating device 51 that generates a rotating magnetic field. This field is received by cable 52 which translates it through barrier wall 53 to a user device 54. The user device is mounted by bearings 55 so it can rotate. It includes windings or other means responsive to the rotating magnetic field, and can thereby be driven. Devices (not shown) such a propellers can be mounted to user device 54.

The term "cable" is used herein to denote a structure which has the same cross-section for a substantial length. It may be short with a large diameter, or long with a thin diameter, or any combination in between.

This invention is not to be limited by the embodiments shown in the drawings and described in the description, which are given by way of example and not of limitation, but only in accordance with the scope of the appended claims.

I claim:

1. A cable having a first end and a second end to translate a remotely-sensed in-situ magnetic image from said first end to said second end, said cable having an axis, an an axial length, said ends being planar and normal to the axis, said cable comprising:

a plurality of strands extending parallel and coherently between each of said ends, said strands comprising a core of magnetizable material, an electric axis non-conductive shield surrounding said core, and a cladding of non-magnetizable material surrounding said shield, said cores being spaced apart and magnetically insulated from one another by paid claddings;

whereby when said first end is placed in a magnetic field which is to be observed, an image of said field will be translated to and received at said second end.

2. A cable according to claim 1 in which an optically transparent cylinder is placed around each said shield to transmit light from said first end to said second end.

3. In combination:

a barrier wall having a first side, a second side, and a passage therethrough extending between said sides, said passage being defined by a peripheral wall; and a cable having an axis, an axial length, a first end and a second end, said ends being planar and normal to said axis, said cable comprising a plurality of strands extending between said ends, and coherently between said ends, each of said strands comprising a core of magnetizable material, and a cladding of non-magnetizable material surrounding each said core, said cable being mounted in said passage in structural and fluid sealing contact with said peripheral wall, said cable having inherent structural strength whereby, when said first end of said cable is exposed to a magnetic field on one side of the barrier wall, said strands convey respective magnetic flux lines from said first and to said second end, thereby to translate an image of the magnetic field from the first side of the barrier wall to the second side of the barrier wall.

4. A combination according to claim 3 in which a user device is located adjacent to said second end of said cable to respond to the translated magnetic field.

5. A combination according to claim 4 in which a magnetic field generator is located adjacent to said first end of said cable to generate a magnetic field for translation to said user device.

6. A combination according to claim 3 in which an electrically non-conductive shield surrounds each said core, between each said core and said cladding.

7. A combination according to claim 6 in which a user device is located adjacent to said second end of said cable to respond to the translated magnetic field.

8. A combination according to claim 7 in which a magnetic field generator is located adjacent to said first end of said cable to generate a magnetic field for translation to said user device.

* * * * *